United States Patent [19]

Sejimo et al.

[11] Patent Number: 4,796,582

[45] Date of Patent: Jan. 10, 1989

[54] ANTI-OVERRUNING DEVICE FOR AN INTERNAL COMBUSTION ENGINE

[75] Inventors: Yoshimi Sejimo, Urayasu; Toshiaki Tsubai, Sendai; Teruhiko Tobinai, Izumi, all of Japan

[73] Assignee: Walbro Far East, Inc., Kawasaki, Japan

[21] Appl. No.: 102,133

[22] Filed: Sep. 29, 1987

[30] Foreign Application Priority Data

Apr. 10, 1987 [JP] Japan ..... 62-88451

[51] Int. Cl.[4] ..... F02D 9/02

[52] U.S. Cl. ..... 123/378; 123/198 D; 123/376

[58] Field of Search ..... 123/332, 333, 351, 360, 123/376, 378, 392, 198 D

[56] References Cited

FOREIGN PATENT DOCUMENTS 172439 10/1983 Japan ..... 123/351

46344 3/1984 Japan ..... 123/378

228736 11/1985 Japan ..... 123/376

261940 12/1985 Japan ..... 123/378

1835 1/1986 Japan ..... 123/378

*Primary Examiner*—Tony M. Argenbright

*Attorney, Agent, or Firm*—Barnes, Kisselle, Raisch, Choate, Whittemore & Hulbert

[57] ABSTRACT

An anti-overrunning device for an internal combustion engine which includes a carburetor with a controlled throttle valve. An actuator for the throttle valve includes a spring-biased rod mounted on a diaphragm. The rod normally urges the throttle valve to a closing position. The actuator includes a pressure actuated diaphgram responsive to pressure from a vibrating pump. This pressure tends to open the throttle valve. A vibration sensor is positioned to relieve pressure on the diaphgram of the actuator and, in response to overrunning of the engine, causes the throttle valve to close in under the influence of the spring bias.

5 Claims, 5 Drawing Sheets

ANTI-OVERRUNING DEVICE FOR AN INTERNAL COMBUSTION ENGINE

REFERENCE TO RELATED APPLICATIONS

Reference is made to the following U.S. applications which are assigned to an assignee common to the present application:

Ser. No. 102,113 - filed Sept. 29, 1987
Ser. No. 102,134 - filed Sept. 29, 1987
Ser. No. 102,354 - filed Sept. 29, 1987
Ser. No. 102,383 - filed Sept. 29, 1987

FIELD OF INVENTION

The present invention relates to a device for inhibiting overrunning of an internal combustion engine utilizing engine vibrations.

OBJECTS AND FEATURES OF THE INVENTION

Portable working machines generally use a two-stroke engine as a power source. Particularly, a diaphragm type carburetor is employed to thereby make it possible to operate a machine in all attitudes. Accordingly, the two-stroke engine is often used for a chain saw, a brush cutter, etc. Generally such a portable working machine is operated with a light-weight, small-size and high-output internal combustion engine in order to enhance the working properties. However, in the chain saw or the brush cutter, when a throttle valve of a carburetor is totally opened under circumstances of a light or no torque load, the engine starts overrunning wherein the R.P.M. becomes excessive and may cause damage to the engine before a load is applied. The overrunning operation can likewise occur after the cutting work has been completed and the torque load is removed.

The overrunning may be avoided if the throttle valve is restored to a low setting every time there is an interruption of the work. However, because the intermittent work is repeatedly carried out, the operator often fails to cut back the throttle, thus resulting in damage to and shortening of the life of the engine.

In the past, this overrunning has been controlled by supplying an overrich fuel mixture to the engine when a throttle valve is fully opened or nearly fully opened under conditions of no or low torque load. However, this system increases the fuel consumption. Also, the ignition plug can become easily fogged, and exhaust fumes increase. Tar or the like tends to accumulate in the muffler.

The present inventors have proposed an anti-overrunning device as disclosed in Japanese Patent Application Laid-Open No. 1835/1986. In this device, a vibrating pump is normally driven to directly supply pressure air to an actuator, but the diaphragm of the vibrating pump is always unsteady due to the vibrations of the engine and, as a result, the operating stability is poor. Also, it is difficult to set an atuating point at which a throttle valve is closed by an actuator during overrunning of the engine. Furthermore, the vibrating pump is provided with a spring to force back the diaphragm, and therefore the amplitude of the diaphragm is restricted. A vibrating pump would have to be increased in size in order to obtain a sufficient pump capacity.

It is therefore an object of the present invention to provide a new anti-overrunning device for an internal combustion engine in which the engine may be run at a reasonable consumption amount of fuel in all running conditions, and, in an overrunning condition (running in excess of a set number of revolutions), a throttle valve is automatically actuated in a closing direction to reduce the amount of fuel-air mixture to the engine, in order to overcome the aforementioned problems.

In order to achieve the above-described object, the present invention provides an arrangement which comprises a vibrating pump for generating pneumatic pressure by vibrations of the engine; an actuator having a rod for urging a throttle valve lever in a direction to close a throttle valve by virtue of the pneumatic pressure of said vibrating pump; and a vibration sensor positioned in a passage for connecting a pressure chamber of the actuator to atmosphere to open the passage by virtue of the vibrations of the engine during overrunning thereof.

BRIEF DESCRIPTION OF THE OPERATION

Figure 1:
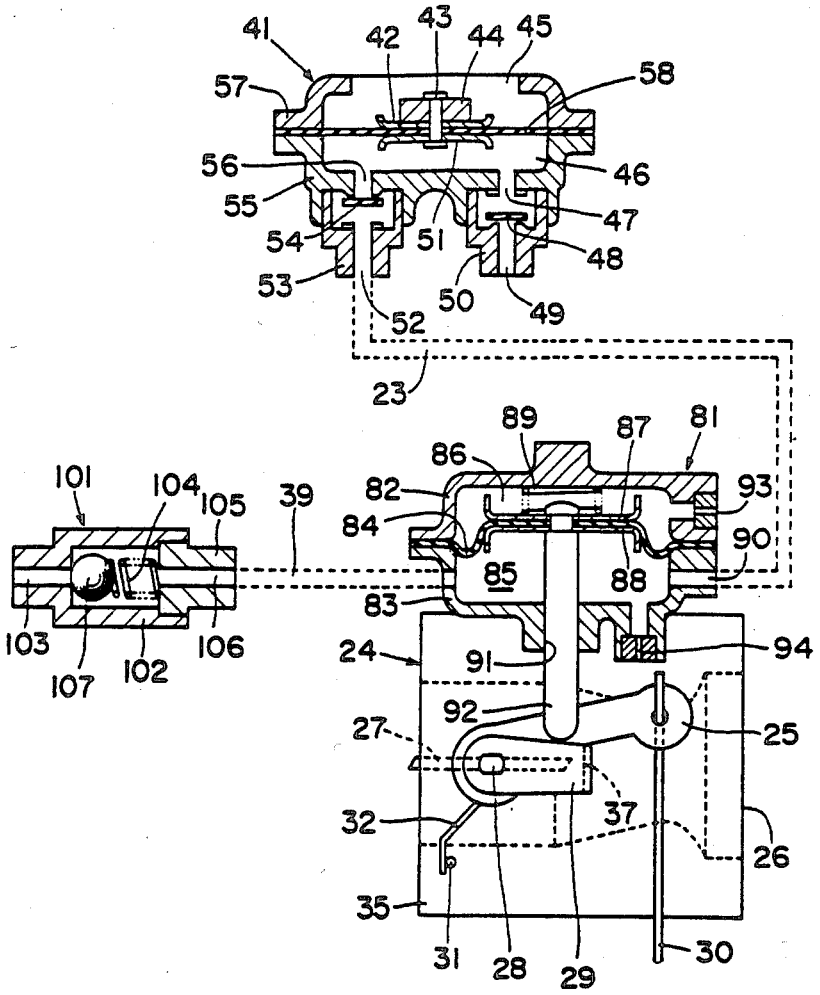
FIG. 1 is a side view showing the structure of an anti-overrunning device for an internal combustion engine according to the present invention.

When the vibrating pump 41 mounted on an engine 10 is subjected to vibrations of the engine, the weight 44 as well as a diaphragm 58 supporting the weight 44 vibrate and positive or negative pressure air in the pressure chamber is fed to a pressure chamber 85 of the actuator 81. Accordingly, rod 92 is retracted against the force of a spring 89.

In the overrunning condition, the virbration of the engine becomes violent, the ball 107 of the vibration sensor 101 moves against the force of the spring 104, and a passage 39 is opened. Accordingly, a pressure chamber 85 is opened to atmosphere and the rod 92 is projected downward by the force of a spring 89. A throttle valve lever 29 as well as a valve shaft 28 are rotated by the rod 92 to reduce the opening of a fuel-air passage controlled by a throttle valve 27. In this manner, the quantity of the fuel-air mixture supplied to the engine is reduced, as a consequence of which the number of revolutions of the engine is lowered and the overrunning is automatically prevented.

DETAILED DESCRIPTION OF THE INVENTION

Figure 3:
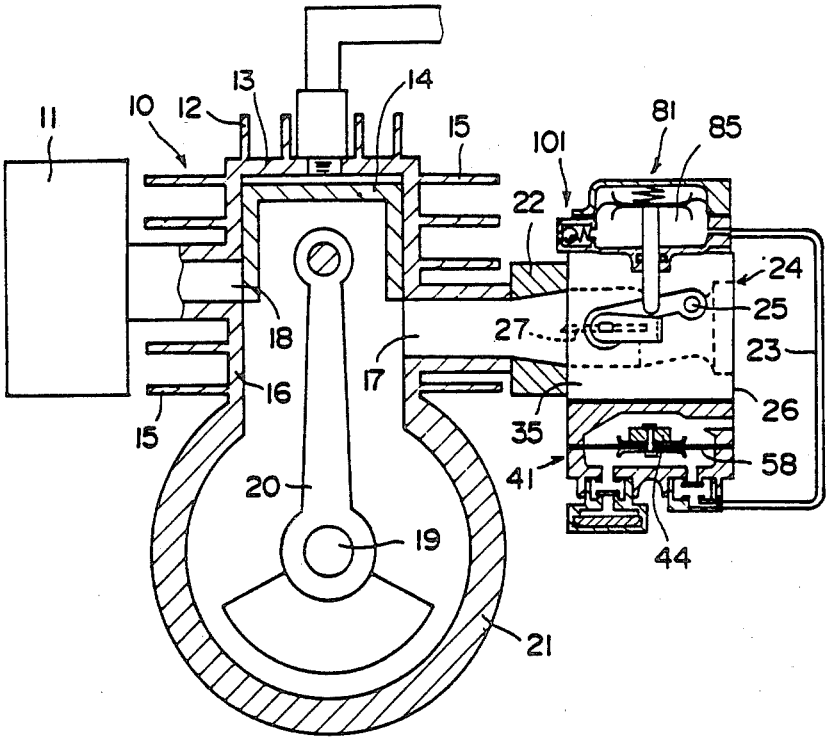
FIG. 3 is a side sectional view of the internal combustion engine provided with the anti-overrunning device.

In the internal combustion engine 10, as shown in FIG. 3, a cylinder 16 having cooling fins 15 is closed at its upper end by a cylinder head 13 having cooling fins 12, and a crank case 21 is connected to the lower end thereof. A piston 14 fitted in the cylinder 16 and a crank shaft 19 supported on the crank case 21 are connected by a connecting rod 20. When the piston 14 is up, a mixture (a mixture of fuel and air) is taken into the crank case 21 from an intake port 17. The mixture is supplied to a chamber between the cylinder head 13 and the piston 14 when the piston 14 is down. As the piston 14 moves up, the mixture is compressed, and fuel is fired near the top dead center. The piston 14 is moved downward by the explosive force, and simultaneously the combustion gas is exhausted outside via the muffler 11 from an exhaust port 18. A carburetor 24 is connected to the intake port 17 through a heat insulating pipe 22. An air cleaner, not shown, is connected to an end wall 26 of a body 35 of the carburetor 24.

Figure 2:
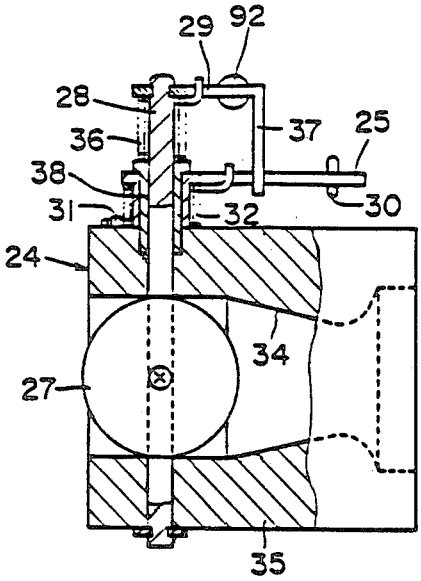
FIG. 2 is a horizontal sectional view of a carburetor provided on the anti-overrunning device.

As shown in FIG. 2, a throttle valve 27 is supported by the valve shaft 28 on a venturi 34 formed on the body 35, and fuel is supplied to the venturi 34 by negative pressure of air passing through the venturi 34. Such a fuel supplying mechanism is known, for example, in U.S. Pat. No. 3,738,623 and directly has nothing to do with the gist of the present invention, and will not be further described.

An upper end of the valve shaft 28 is rotatably supported on the body 35 by means of a bearing sleeve 38, and an inverted L-shaped throttle valve lever 29 is secured to the upper end. One end of a spring 36 wound around the valve shaft 28 is placed in engagement with the throttle valve lever 29 and the other end thereof placed in engagement with the bearing sleeve 38. Also, a boss portion of the lever 25 is slipped over the bearing sleeve 38, and one end of a spring 32 wound around the boss portion is placed in engagement with the lever 25 whereas the other end is placed in engagement with a pin 31 of the body 35. An engaging portion 37 of the throttle valve lever 29 is projected downwardly so that it may engage with the edge of the lever 25.

In FIG. 1, the throttle valve lever 29 is pivotally urged counterclockwise by the force of the spring 36 to cause the engaging portion 37 to abut against the lever 25. The lever 25 is pivotally urged clockwise by the strong force of the spring 32 to close the throttle valve 27. When the lever 25 is rotated counterclockwise against the force of the spring 32 by a trigger wire 30, the throttle valve lever 29 also follows the lever 25 to increase a throttle controlled opening degree by movement of the throttle valve 27.

The anti-overrunning device of the internal combustion engine according to the present invention is composed of a vibrating pump 41, an actuator 81 for reducing the throttle opening by movement of the throttle valve 27 through the throttle valve lever 29 and a vibration sensor 101.

The vibrating pump 41 has a diaphragm 58 sandwiched between cup-like housings 57 and 55 to form an atmospheric chamber 45 and a pressure chamber 46. Pad plates 42 and 51 are placed on both surfaces of a diaphragm 58, and a weight 44 is connected by means of a rivet 43. The pressure chamber 46 is provided with passages 56 and 47, to which port members 53 and 50, respectively, are connected. The port member 53 is provided with a check valve 54 to allow a flow of air from the passage 56 to a passage 52. The port member 50 is provided with a check valve 48 to allow a flow of air from an atmospheric opening 49 to the passage 47 through a strainer 60 (refer to FIG. 4). The passage 52 is connected to an inlet 90 of the actuator 81 by a pipe 23.

The actuator 81 has a diaphragm 84 sandwiched between cup-like housings 82 and 83 to form a pressure chamber 85 and an atmospheric chamber 86. Pad plates 87 and 88 are placed on both surfaces of the diaphragm 84, the plates being connected by the base end of a rod 92. The rod 92 slidably inserted into a hole 91 of the housing 83 is projected outward by means of a spring 89 interposed between the pad plate 87 and the housing 82. The fore end of the rod 92 is placed into abutment with the aforementioned throttle valve lever 29. The pressure chamber 85 and the atmospheric chamber 86 are provided with orifices 93 and 94 in communication with atmosphere respectively, whereby the extreme operation of the actuator 81 may be restricted.

The vibration sensor 101 is so designed that a closure 105 having a passage 106 is connected to the end of a cup-like housing 102, and a ball 107 is urged against a seat at the end of a passage 103 by means of a spring 104 accommodated in the housing 102.

Figure 4:
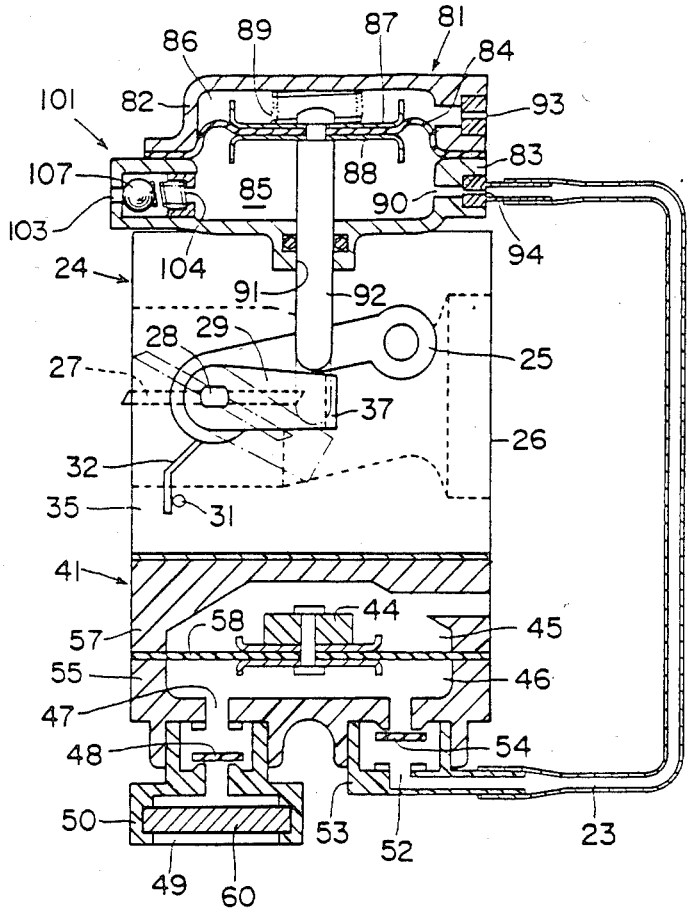
FIG. 4 is a side sectional view showing the manner in which the anti-overrunning device according to the first embodiment of the present invention is mounted on the carburetor.

The above-described vibrating pump 41 is preferably integrally connected to the lower end wall of the body 35 of the carburetor 24, and the actuator 81 and the vibration sensor 101 are connected to the upper end wall of the body 35, as shown in FIG. 3. The vibrating pump 41 and the actuator 81 are connected by the pipe 23. However, the vibrating pump 41 and the vibration sensor 101 may be mounted suitably on the engine 10. FIG. 4 is an enlarged view showing an embodiment wherein a vibrating pump, a vibration sensor and an actuator are mounted on the body of a carburetor.

It is to be noted that the diaphragm 58 of the vibrating pump 41 can be formed from a rubber impregnated fabric, a thin resin plate, or a thin metal plate other than a rubber plate. The shape of the diaphragm can be of a convolution type or a bellows-phragm type other than the flat plate. The weight 44 may be mounted interiorly of the pressure chamber 46 or mounted interiorly of both atmospheric chamber 45 and pressure chamber 46.

The actuating point of the vibration sensor 101 may be suitably set by varying the diameter and weight of the ball 107, the set load of the spring 104, the inside diameter of the seat portion of the passage 103 and the like. A configuration may be made so that the ball 107 is urged against the passage 106 by means of a spring.

In the following, the operation of the anti-overrunning device for the internal combustion engine according to the present invention will be described. Under conditions where the engine is operating at less than a predetermined number of revolutions, the intensity of the vibrations of the engine is weak, the vibration sensor 101 is in its closed state, that is, the passage 39 is closed by the ball 107. Upon receipt of the vibration of the engine, the diaphragm of the vibrating pump 41 vibrates up and down by reason of the weight 44 supported on the diaphragm 58. When the diaphragm 58 is inflated upwardly, pressure of the pressure chamber 46 lowers, and therefore the check valve 48 opens to take air into the pressure chamber 46 from the atmosphere opening 49 having strainer 60. Subsequently, when the diaphragm 58 is inflated downwardly, the positive pressure air in the pressure chamber 46 causes the check valve 54 to open and air under pressure is discharged toward the pipe 23. Accordingly, the air is supplied to the pressure chamber 85 of the actuator 81 via the pipe 23 from the pressure chamber 46. The rod 92 is forced upward against the force of the spring 89 and is moved away from the lever 29. Thus, the opening position of the throttle valve 27 is determined by the operating position of the lever 25 actuated by the trigger wire 30.

When the engine is operating a level above a predetermined number of revolutions, that is, in an overrunning state, the ball 107 of the vibration sensor 101 vibrates against the force of the spring 104 to open the passage 39 (FIG. 1). The pressure in the pressure chamber 85 is released to atmosphere and the rod 92 is forced down by the force of the spring 89. Thus, the throttle valve lever 29 is rotated clockwise along with the valve shaft 28, as shown by the chain lines in FIG. 4, and the opening controlled by the throttle valve 27 is reduced. As a result, the flow rate of the fuel mixture taken into the engine is reduced, and the number of revolutions of the engine decreases.

When the number of revolutions of the engine decreases, the intensity of the vibrations transmitted from the engine to the vibration sensor 101 is weakened (the amplitude is small), and therefore again the passasge 39 is closed by the ball 107. Then, the positive pressure air is supplied to the pressure chamber 85 of the actuator 81 from the vibrating pump 41, and the rod 92 is raised upward by the positive pressure against the force of the spring 89. The throttle valve lever 29 is rotated counterclockwise by the force of the spring 36, and the engaging portion 37 impinges upon the edge of the lever 25. In this manner the fuel opening controlled by the throttle valve 27 increases, and again the number of revolutions of the engine increases.

The position of the throttle valve 27 is determined by the rotated position of the lever 25 operated by the trigger wire 30. When the number of revolutions of the engine again increases and exceeds a predetermined number of revolutions, the vibration sensor 101 again opens, and the opening degree of the throttle valve 27 is decreased by the spring 89 of the actuator 81. The operation as described above is repeated whereby the operation of the engine is maintained at less than a predetermined number of revolutions, and the overrunning of the engine is automatically prevented without the need for the operator's operation of the trigger wire 30 according to the variation of load.

Figure 5:
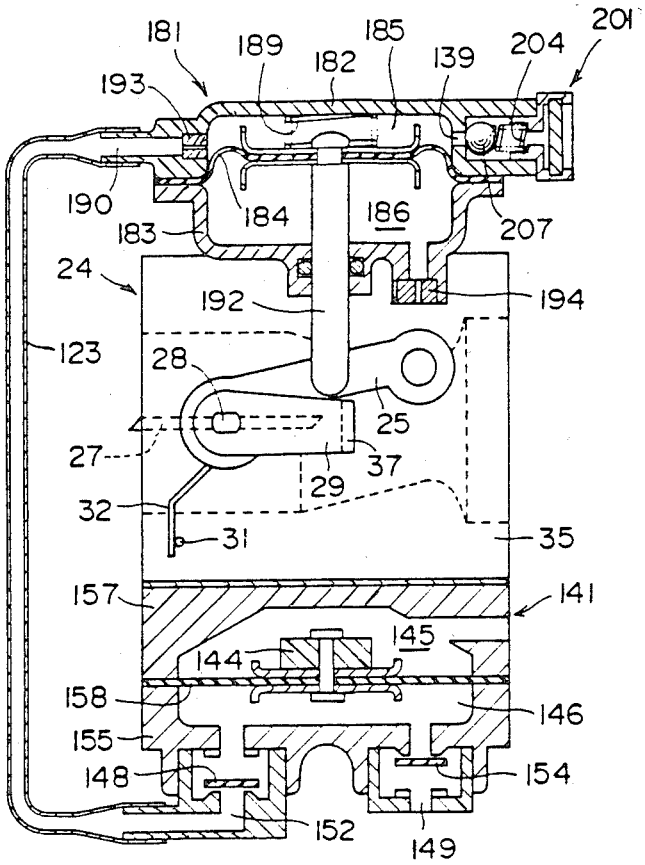
FIG. 5 is a side sectional view showing the manner in which the anti-overrunning device according to the second embodiment of the present invention is mounted on the carburetor.

In the embodiment shown in FIG. 5, an actuator 181 connected to the upper end wall of the body 35 of the carburetor 24 is actuated by negative pressure supplied from a vibrating pump 141. Members corresponding to those shown in FIG. 4 are indicated by reference numerals to which 100 is added. Provided in an atmospheric opening 149 of the vibrating pump 141 is a check valve 154 to allow a flow of air from a pressure chamber 146 to the outside. On the other hand, provided on a passage 152 is a check valve 148 to allow a flow of air from the actuator 181 to the pressure chamber 146.

The vibration sensor 201 is designed so that a ball 207 is urged against the end of a passage 139 by means of a spring 204 accommodated in a housing integral with the actuator 181.

The actuator 181 has a diaphragm 184 sandwiched between housings 182 and 183 to form a pressure chamber 185 and an atmospheric chamber 186, the atmospheric chamber 186 (and pressure chamber 185) being connected to atmosphere by orifice 194. Passage 123 connects orifice 193 with passage 152 and check valve 148. A rod 192 connected to the diaphragm 184 is urged upward by negative pressure supplied from the vibrating pump 141 to the pressure chamber 185 against the force of a spring 189.

When the engine exceeds a predetermined number of revolutions to increase vibrations, a ball 207 of the vibration sensor 201 moves against the force of the spring 204 to open the passage 139. Accordingly, the negative pressure in chamber 185 of the actuator 181 is reduced by being opened to atmosphere through the vibration sensor 201 and thence the rod 192 is urged down by the force of the spring 189, the throttle valve lever 29 is rotated clockwise, the opening controlled by the throttle valve 27 is reduced, and the number of revolutions of the engine decreases. Thereafter, the overrunning of the engine is prevented in a manner similar to that of the embodiment shown in FIG. 4.

As described above, the present invention comprises a vibrating pump for generating pneumatic pressure by vibrations of the engine; an actuator having a rod for urging a throttle valve lever in a direction to close a throttle valve by virtue of the pneumatic pressure of said vibrating pump; and a vibration sensor positioned in a passage for communicating a pressure chamber of said actuator to atmosphere to open said passage by virtue of the vibrations of the engine during overrunning thereof. Only a weight is mounted on the diaphragm of the vibrating pump and a return spring is not present. Therefore, a device which is small but has a sufficient pump capacity may be obtained. Moreover, it is possible to suitably set the maximum number of revolutions of the engine according to the formulation of the vibration sensor.

According to the present invention, during the overrunning of the engine, the opening degree of the throttle valve of the carburetor is automatically reduced to reduce the flow rate of the mixture taken into the engine. Therefore, there is provided a new anti-overrunning device which is positive in operation, may be run at a substantially reasonable fuel cost (rate of fuel consumption) in all running levels of the engine, is free of spark plug fouling, produces less exhaust fume, and results in less tar accumulation in the muffler.

Furthermore, since the operator can perform his work while a throttle handle is left fully opened because of actuation of the anti-overrunning device, the working efficiency may be enhanced, and the damage to, and the shortening of life of, the engine may be avoided.

We claim:

1. An anti-overrunning device for an internal combustion engine comprising a vibrating pump for generating pneumatic pressure by vibrations of the engine; an actuator having a spring-biased rod for urging a throttle valve lever in a direction of closing a throttle valve and responsive to the pneumatic pressure of said vibrating pump to act against said spring to open said throttle valve; and a vibration sensor positioned in a passage for communicating a pressure chamber of said actuator to atmosphere by virtue of the vibrations of the engine during overrunning thereof and cause said spring-biased rod to move said throttle valve in a closing direction.

2. An anti-overrunning device for an internal combustion engine according to claim 1, wherein said vibrating pump comprises an atmospheric chamber and a pressure chamber which are defined within a housing by a diaphragm having weight, said vibrating pump further comprises a check valve to allow a flow of air from the exterior into said pressure chamber, and a check valve to allow a flow of air from said pressure chamber into said actuator.

3. An anti-overrunning device for an internal combustion engine according to claim 1, wherein said vibrating pump comprises an atmospheric chamber and a pressure chamber which are defined within a housing by a diaphragm having weight, said vibrating pump furhter comprises a check valve to allow a flow of air from said actuator into said pressure chamber, and a check valve to allow a flow of air from said pressure chamber to atmosphere.

4. An anti-overrunning device for an internal combustion engine according to claim 1, wherein said actuator comprises a pressure chamber and an atmospheric chamber which are defined within a housing by a diaphragm supporting a rod, and further comprises a spring for urging said rod connected to said diaphragm in a direction of closing said throttle valve.

5. An anti-overrunning device for an internal combustion engine according to claim 1, wherein said vibration sensor comprises a ball received within a housing and urged by means of a spring in a direction of closing said passage for communicating said pressure chamber to atmosphere.

* * * * *

UNITED STATES PATENT AND TRADEMARK OFFICE

CERTIFICATE OF CORRECTION

PATENT NO. : 4,796,582

DATED : January 10, 1989

INVENTOR(S) : Yoshimi Sejimo, Toshiaki Tsubai, Teruhiko Tobinai

It is certified that error appears in the above-identified patent and that said Letters Patent is hereby corrected as shown below:

Col. 1, Line 59, change "atuating" to "actuating".

Col. 4, Line 66, after "operating" insert "at".

Col. 5, Line 57, delete "(and pressure chamber 185)".

Signed and Sealed this

Sixth Day of June, 1989

*Attest:*

DONALD J. QUIGG

*Attesting Officer*

*Commissioner of Patents and Trademarks*